US005507434A

United States Patent [19]

Chambers

[11] Patent Number: 5,507,434

[45] Date of Patent: Apr. 16, 1996

[54] CLAMP MOUNT FOR CONCRETE TIES

[75] Inventor: Merrill W. Chambers, Blue Springs, Mo.

[73] Assignee: Harmon Industries, Inc., Blue Springs, Mo.

[21] Appl. No.: 261,000

[22] Filed: Jun. 16, 1994

[51] Int. Cl.[6] ..... F01B 3/48

[52] U.S. Cl. ..... 238/105

[58] Field of Search ..... 238/104, 105, 238/14.05, 14.4, 27, 29, 310, 338, 340, 350, 364; 248/231.4, 343, 906, 201, 207

[56] References Cited

U.S. PATENT DOCUMENTS 2,041,382 5/1936 Strong ..... 246/393
2,490,742 12/1949 Smith ..... 246/393
2,729,414 1/1956 Clark ..... 248/343
3,881,698 5/1975 Marsh ..... 248/231.4

*Primary Examiner*—Robert J. Oberleitner
*Assistant Examiner*—S. Joseph Morano
*Attorney, Agent, or Firm*—Chase & Yakimo

[57] ABSTRACT

Apparatus for mounting an impedance bond or other device between a pair of spaced, concrete railroad ties employs a clamping plate which overlies and spans the ties, and a pair of clamping feet that are installed between the ties. Components interconnecting the plate and the feet draw the plate and feet toward one another to securely clamp the ties therebetween. The device to be mounted between the ties is secured to the undersurface of the plate and is thus held in a fixed position in the space between the ties. The spacing between the feet may be varied to accommodate different tie spacings, and the entire installation is accomplished without embedding fasteners in the concrete tie material.

6 Claims, 3 Drawing Sheets

CLAMP MOUNT FOR CONCRETE TIES

BACKGROUND OF THE INVENTION

This invention relates to improvements in means for mounting electrical devices or other apparatus in the space between an adjacent pair of concrete railroad ties and, in particular, to a mounting means which does not require the drilling of holes in the ties or the use of special fasteners cast in the concrete.

Wooden railroad ties ultimately require replacement after years of use and exposure to the elements. With lessening availability of timber having the size and durability characteristics needed for quality ties, the use of railroad ties cast from concrete has become widespread. Although the concrete tie is a suitable substitute, concrete is not as convenient a material in the field when the ties must be used to support electrical or mechanical devices along the track. A particular problem is presented with respect to the mounting of impedance bonds that are widely used in the operation of electrified trains.

The bond device comprises a large inductor enclosed in an essentially cubical housing approximately nine or ten inches (22.5 to 25 cm.) in height, length and width. When mounted between the rails and connected thereto, the bond provides a direct-current short for the propulsion current but sufficient impedance to accommodate alternating current track circuits. With wooden ties mounting is a simple matter as brackets may be simply nailed to the adjacent ties between which the bond is placed.

SUMMARY OF THE INVENTION

It is, therefore, the primary object of the present invention to provide apparatus for mounting a device, such as an impedance bond or the like, between a pair of spaced railroad ties to which standard fasteners, e.g., nails and screws, cannot be readily applied in order to facilitate the mounting of such devices between concrete ties.

As a corollary to the foregoing object, it is important aim of the present invention to provide such a mounting apparatus which grips adjacent ties by a clamping action and may be easily installed in order to mount a trackside device between a pair of adjacent ties.

Another important object of the present invention is to provide a mounting apparatus which clamps on to adjacent ties through the use of clamping feet which are installed beneath the ties by insertion thereunder, a clamping member overlying the ties being drawn toward the installed feet to clamp the ties securely therebetween and provide a fixed mounting structure.

Another important object of this invention is to provide such a mounting apparatus in which the overlying clamping member and the underlying feet are interconnected by telescoping components through which fasteners extend and are tightened to draw the member and feet into clamping engagement with the ties.

A further and important object of the invention is to provide such an apparatus which accommodates ties having a range of spacing therebetween in order to provide a universal mount for impedance bonds and other devices.

Other objects will become apparent as the detailed description proceeds.

DETAILED DESCRIPTION

Figure 1:
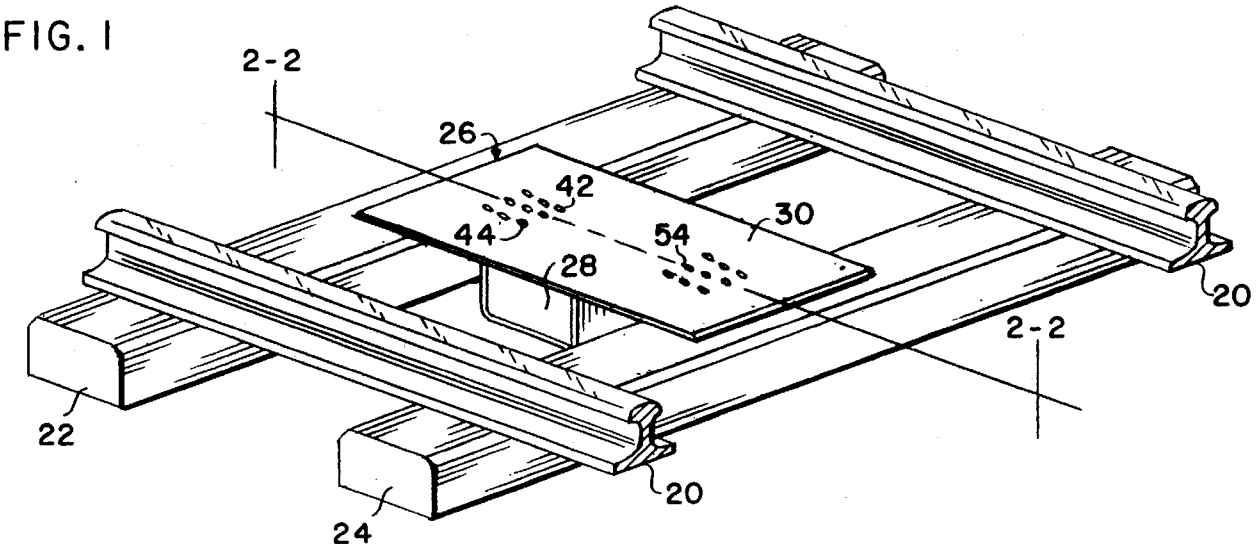
FIG. 1 is a fragmentary, perspective view of a railroad track showing a pair of spaced concrete ties and the apparatus of the present invention mounted thereon.
Figure 2:
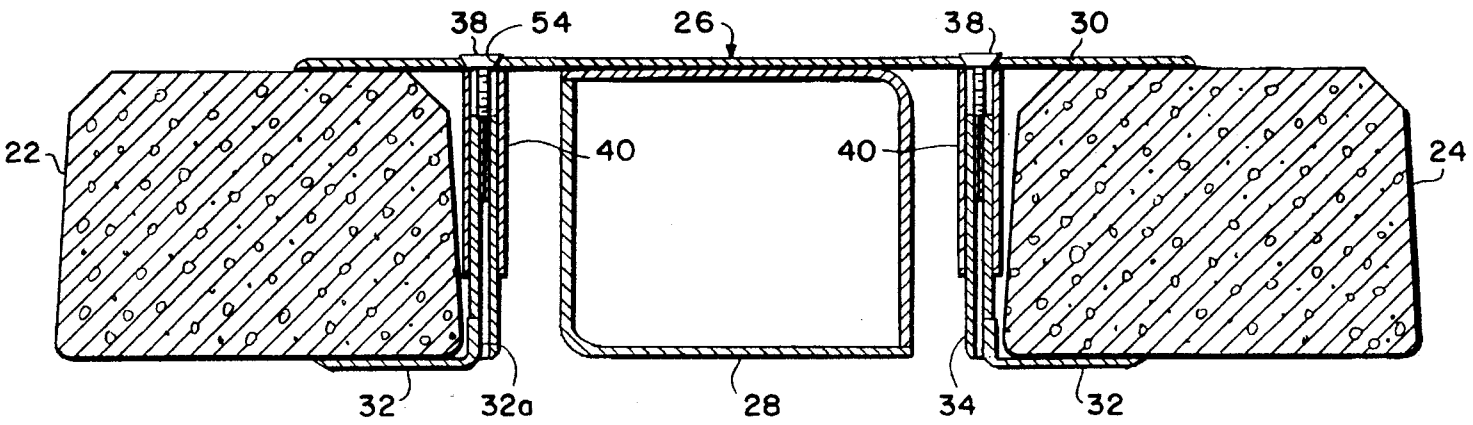
FIG. 2 is a vertical sectional view on an enlarged scale taken along line 2—2 of FIG. 1, showing the mounting apparatus secured to ties having a wide spacing therebetween.

Referring initially to FIGS. 1 and 2, a pair of rails 20 of a railroad track are shown on a pair of spaced, concrete ties 22 and 24, it being appreciated that FIG. 1 is a fragmentary showing and that there are a multitude of such ties along the run of the rails 20. The apparatus of the present invention is shown at 26 secured to the ties 22 and 24 for the purpose of mounting a housing 28 in the space between the ties 22 and 24. It should be understood that the housing 28 shown herein contains an impedance bond used on electrified railroad lines, but that such use is purely illustrative as the apparatus 26 may be employed to mount any device between the ties 22 and 24 necessary for the operation of a given railroad. Apparatus 26 includes a mounting member 30 in the nature of a rectangular clamping plate overlying and spanning the ties 22 and 24, a pair of outwardly extending clamping feet 32 installed at the facing sides of the ties, and mechanism between plate 30 and feet 32 for drawing these components toward one another to clamp the ties 22 and 24 therebetween as will be described hereinafter.

Figure 3:
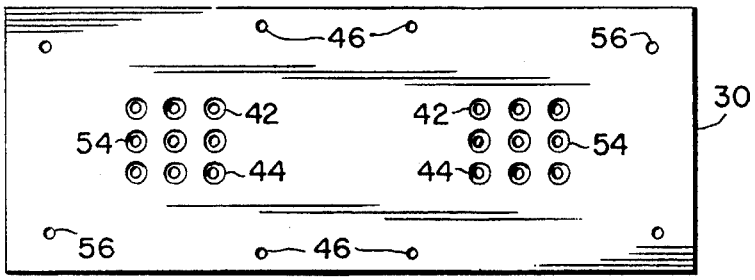
FIG. 3 is a plan view of the clamping plate that overlies and spans the ties.
Figure 4:
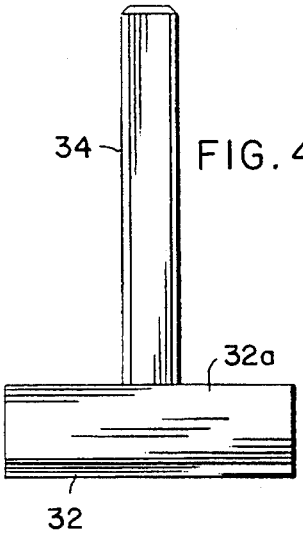
FIG. 4 is an enlarged, frontal view of one of the clamping feet.
Figure 7:
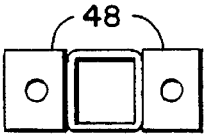
FIG. 7 is a plan view, on the same scale as FIGS. 4–6, of the upper end of a connecting sleeve.
Figure 8:
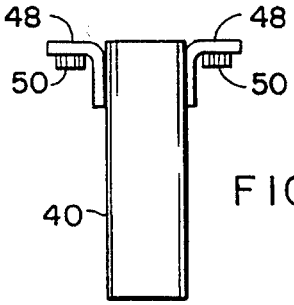
FIG. 8 is a side elevational view of the sleeve shown in FIG. 7.
Figure 5:
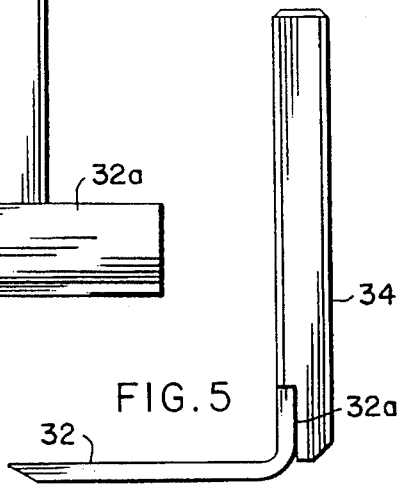
FIG. 5 is a side elevational view of the foot shown in FIG. 4.
Figure 6:
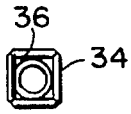
FIG. 6 is a detail view, in plan, of the upper end of the upstanding leg on the foot shown in FIGS. 4 and 5, revealing a threaded insert therewithin.
Figure 9:
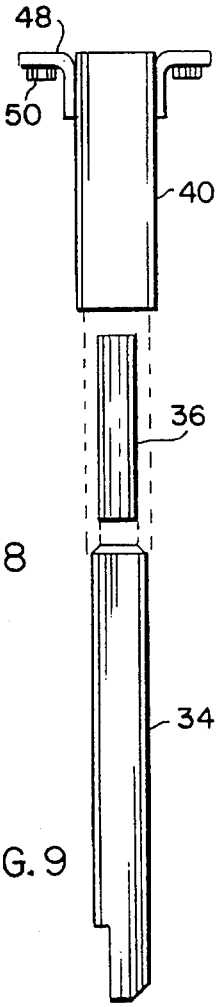
FIG. 9 is an exploded view of the leg, insert and sleeve.
Figure 10:
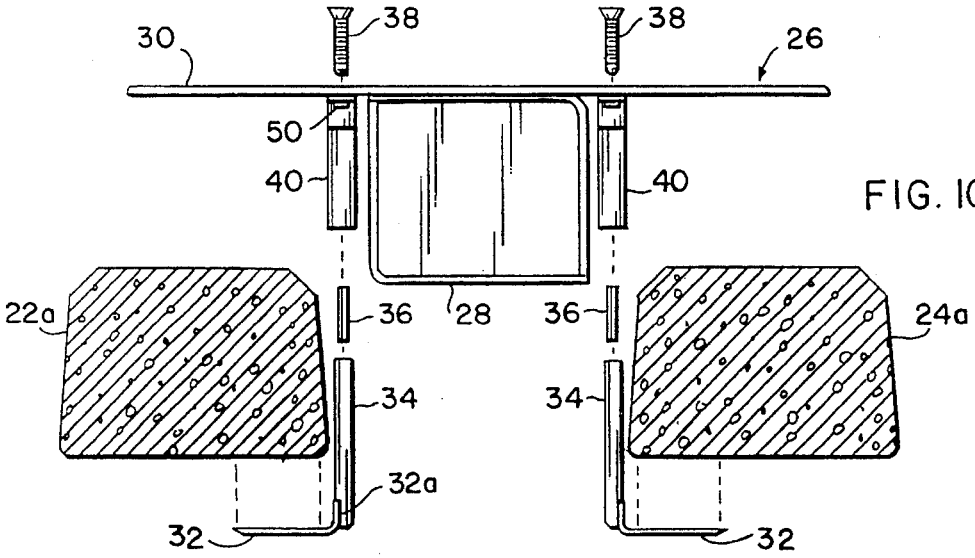
FIG. 10 is an exploded, vertical cross-sectional view through the ties on the same scale as FIG. 3 showing the components of the mounting apparatus in elevation, the ties being shown having a narrow spacing as compared with FIG. 2.
Figure 11:
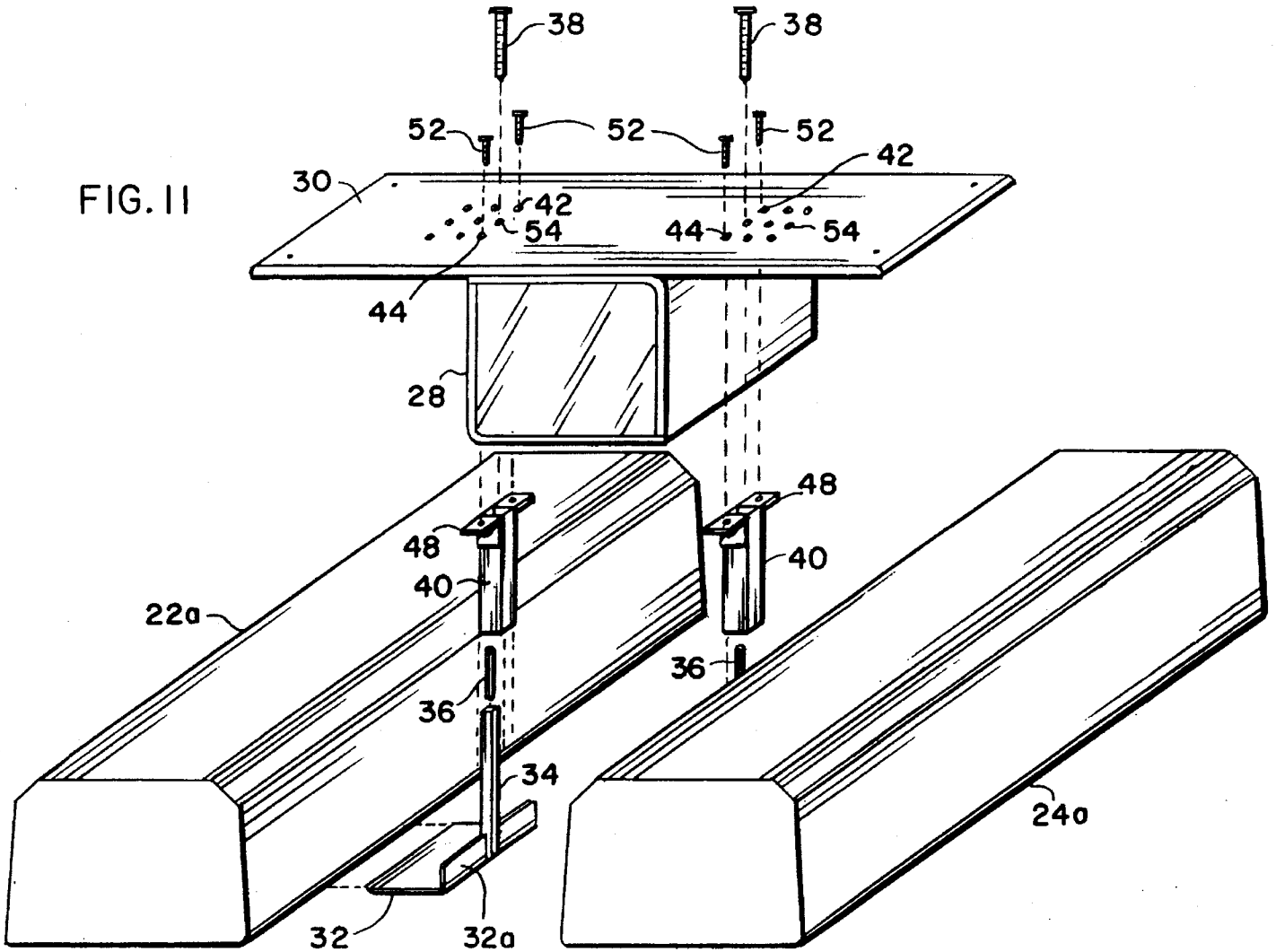
FIG. 11 is an exploded, perspective view of the mounting apparatus as seen in FIG. 10 in use with closely spaced ties.

Individual components of the apparatus are shown in FIGS. 3–9. The two feet 32 are identical in construction and are connected in the present invention to the overlying plate 30 in the same manner. One foot 32 is shown in FIGS. 4 and 5 where it may be seen that it comprises an angle member welded to an upstanding leg 34 formed by a hollow, rectangular shaft. A cylindrical insert 36 (FIGS. 6 and 9) is held in the upper end portion of leg 34 by a press fit and is internally threaded to receive a screw 38, two such screws for the respective leg assemblies being shown in FIGS. 2, 10 and 11. Each leg 34 and its threaded insert 36 provide a connecting element that is telescopically received within a tubular connecting sleeve 40 that depends from plate 30.

As best seen in FIG. 3, plate 30 has two sets of three longitudinally spaced holes 42 and two sets of three longitudinally spaced holes 44. Four fasteners 46 extend through plate 30 and secure housing 28 to the bottom surface thereof at the middle of plate 30 between the sets of holes 42, 44. Each of the sleeves 40 has a pair of outwardly projecting, apertured ears 48 on its upper end under which nuts 50 are welded in order to receive screws 52 (FIG. 11) which secure the two sleeves 40 to the plate 30 at the bottom surface thereof at either of the three hole positions provided by hole sets 42 and 44. It may be appreciated that in FIG. 11, for example, the screws 52 extend through the innermost holes 42 and 44 corresponding to the narrower spacing of the ties 22*a* and 24*a*.

The clamping plate 30 is also provided with two sets of three holes 54 between the rows of holes 42 and 44 for the purpose of receiving the two screws 38 that are threaded into the inserts 36 in legs 34. Again with reference to FIG. 11, it may be seen at the narrower tie spacing there shown that the screws 38 extend through the innermost holes 54 and thus along the central axes of corresponding sleeves 40 into the inserts 36. In contrast, referring to the wide spacing shown in FIG. 2, screws 38 and also the screws 52 (not shown in the cross section) extend through the outermost holes 54, 42 and 44. For intermediate spacings of the ties, the middle holes 42, 44 and 54 may be used. This permits the mounting apparatus to accommodate variations in tie spacing that may be encountered.

In use, the mounting apparatus 26 is initially disassembled, i.e., the feet 32 and legs 34 are disconnected from the other components. This permits the shovel-like feet 32 to be installed beneath the ties with simple tools. Digging out the earth at the bottom of each tie with a shovel may be required in some installations, but typically several blows with a hammer against the upstanding flange 32*a* of the foot will effect insertion to a position where the foot is essentially completely under the tie as seen in FIG. 2. The clamping plate 30 is then positioned over the upstanding legs 34 with the sleeves 40 vertically aligned therewith, the installer having selected the locations of holes 42 and 44 to achieve the required alignment. Finally, screws 38 are inserted and tightened to draw the plate 30 into clamping engagement with the upper surface of the ties 22 and 24 (or 22*a* and 24*a*) while also causing the feet 32 to forcibly engage the bottom of the ties. Once the screws 38 are tightened, the ties are tightly clamped between the plate 30 and the feet 32 to secure the housing 28 in a fixed position in the space between the ties. If desired, hard rubber compression pads (not shown) may be inserted between the clamping end portions of the plate 30 and the underlying upper surfaces of the concrete ties.

Accordingly, the present invention provides a mounting apparatus which does not require that fasteners be emplaced in concrete ties or that fastening elements be cast thereinto. Conventional wooden ties may also be accommodated by the provision of mounting holes 56 at the four corners of the plate 30 for receiving nails or other fasteners.

Having thus described the invention, what is claimed as new and desired to be secured by Letters Patent is:

1. In combination with a pair of railroad ties presenting spaced, facing sides, apparatus for mounting a device between the ties comprising:

a mounting member overlying and spanning said pair of ties, means on said member for securing said device thereto between the ties, a pair of clamping feet each installed beneath a corresponding tie, each foot being provided with an upstanding connecting element disposed adjacent the facing side of the corresponding tie, and means on said member engageable with said elements for drawing the member and the feet toward one another to clamp the ties therebetween, and for holding the member and feet in clamping engagement with the ties to thereby mount the device therebetween.

2. The apparatus as claimed in claim 1, wherein said securing means mounts said device between said connecting elements.

3. The apparatus as claimed in claim 1, further comprising a pair of spaced, depending connecting components on said member in telescoping relationship with the respective elements.

4. The apparatus as claimed in claim 3, wherein said member has means for attaching said components thereto at any one of a plurality of spaced locations selected to align said components with the respective elements.

5. The apparatus as claimed in claim 1, wherein said member comprises a clamping plate, and wherein said drawing means includes a pair of fasteners on said plate for engaging the respective elements.

6. The apparatus as claimed in claim 5, further comprising a pair of spaced, depending sleeves on said plate in telescoping relationship with the respective elements, said fasteners extending within respective sleeves into engagement with said elements.

* * * * *